US011508283B2

(12) United States Patent
Jeong

(10) Patent No.: US 11,508,283 B2
(45) Date of Patent: Nov. 22, 2022

(54) DATA DRIVING DEVICE AND PANEL DRIVING METHOD OF DATA DRIVING DEVICE

(71) Applicant: LX Semicon Co., Ltd., Daejeon (KR)

(72) Inventor: Hyun Woo Jeong, Daejeon (KR)

(73) Assignee: LX Semicon Co., Ltd., Daejeon (KR)

( * ) Notice: Subject to any disclaimer, the term of this patent is extended or adjusted under 35 U.S.C. 154(b) by 0 days.

(21) Appl. No.: 17/544,871

(22) Filed: Dec. 7, 2021

(65) Prior Publication Data

US 2022/0189374 A1 Jun. 16, 2022

(30) Foreign Application Priority Data

Dec. 10, 2020 (KR) ..... 10-2020-0172277

(51) Int. Cl.
*G09G 3/20* (2006.01)

(52) U.S. Cl.
CPC ... *G09G 3/2003* (2013.01); *G09G 2300/0828* (2013.01); *G09G 2310/0243* (2013.01); *G09G 2310/0291* (2013.01); *G09G 2310/08* (2013.01)

(58) Field of Classification Search
CPC ..... G09G 3/2003; G09G 2300/0828; G09G 2310/0243; G09G 2310/0291; G09G 2310/08
See application file for complete search history.

(56) References Cited

U.S. PATENT DOCUMENTS

| | | | | |
|---|---|---|---|---|
| 7,612,788 | B2 | 11/2009 | Chang et al. | |
| 2006/0158420 | A1 | 7/2006 | Chang et al. | |
| 2011/0157249 | A1 | 6/2011 | Park | |
| 2014/0085349 | A1* | 3/2014 | Shiibayashi | G09G 3/3696 345/690 |

FOREIGN PATENT DOCUMENTS

| | | | |
|---|---|---|---|
| KR | 10-0687041 | B1 | 2/2007 |
| KR | 10-2011-0075158 | A | 7/2011 |
| KR | 10-1585683 | B1 | 1/2016 |
| KR | 10-1603297 | B1 | 3/2016 |
| KR | 10-2013381 | B1 | 8/2019 |

* cited by examiner

*Primary Examiner* — Kenneth B Lee, Jr.

(74) *Attorney, Agent, or Firm* — Fenwick & West LLP

(57) ABSTRACT

The present disclosure relates to a data driving device and a panel driving method of the data driving device. More particularly, it relates to a data driving device and a panel driving method of the data driving device in which a programmable gamma circuit is applied to a gamma voltage circuit of the data driving device and some components of a channel circuit are used in common so as to reduce the size of the data driving device.

9 Claims, 8 Drawing Sheets

DATA DRIVING DEVICE AND PANEL DRIVING METHOD OF DATA DRIVING DEVICE

CROSS REFERENCE TO RELATED APPLICATION

This application claims priority from Korean Patent Application No. 10-2020-0172277, filed on Dec. 10, 2020, which is hereby incorporated by reference for all purposes as if fully set forth herein.

BACKGROUND

1. Technical Field

Various embodiments generally relate to a data driving device and a panel driving method of the data driving device.

2. Related Art

In general, a data driving device of a display device converts image data into data voltages and supplies the data voltages to a display panel.

Such a data driving device generates gamma reference voltages for converting the image data into the data voltages.

Because the existing data driving device includes gamma voltage circuits corresponding to R (red), G (green) and B (blue), respectively, the size of the data driving device increases. Therefore, an area occupied by the data driving device in the display device increases.

SUMMARY

Under such a background, in one aspect, various embodiments are directed to providing a technology in which a programmable gamma circuit is applied to a gamma voltage circuit of a data driving device and some components of a channel circuit are used in common, thereby reducing the size of the data driving device.

In one aspect, an embodiment may provide a data driving device including: a gamma voltage circuit configured to output first gamma reference voltages corresponding to a first color during a first horizontal driving period, to output second gamma reference voltages corresponding to a second color during a second horizontal driving period, and to output third gamma reference voltages corresponding to a third color during a third horizontal driving period; and a channel circuit configured to output a first data voltage by using first color data corresponding to the first color and the first gamma reference voltages during the first horizontal driving period, to output a second data voltage by using second color data corresponding to the second color and the second gamma reference voltages during the second horizontal driving period, and to output a third data voltage by using third color data corresponding to the third color and the third gamma reference voltages during the third horizontal driving period.

In another aspect, an embodiment may provide a method for driving a display panel by a data driving device, including: receiving first color data corresponding to all channels of the display panel and a first gamma set value from a data processing device; generating first gamma reference voltages corresponding to a first color by using the first gamma set value during a first horizontal driving period; generating first data voltages by using the first color data and the first gamma reference voltages; supplying the first data voltages to first color pixels disposed on one row of the display panel; receiving second color data corresponding to all the channels of the display panel and a second gamma set value from the data processing device; generating second gamma reference voltages corresponding to a second color by using the second gamma set value during a second horizontal driving period; generating second data voltages by using the second color data and the second gamma reference voltages; supplying the second data voltages to second color pixels disposed on the one row; receiving third color data corresponding to all the channels of the display panel and a third gamma set value from the data processing device; generating third gamma reference voltages corresponding to a third color by using the third gamma set value during a third horizontal driving period; generating third data voltages by using the third color data and the third gamma reference voltages; and supplying the third data voltages to third color pixels disposed on the one row.

As is apparent from the above description, according to the embodiments, a programmable gamma circuit may be applied to a gamma voltage circuit of a data driving device and some components of a channel circuit may be used in common, which makes it possible to reduce the size of the data driving device.

DETAILED DESCRIPTION

Figure 1:
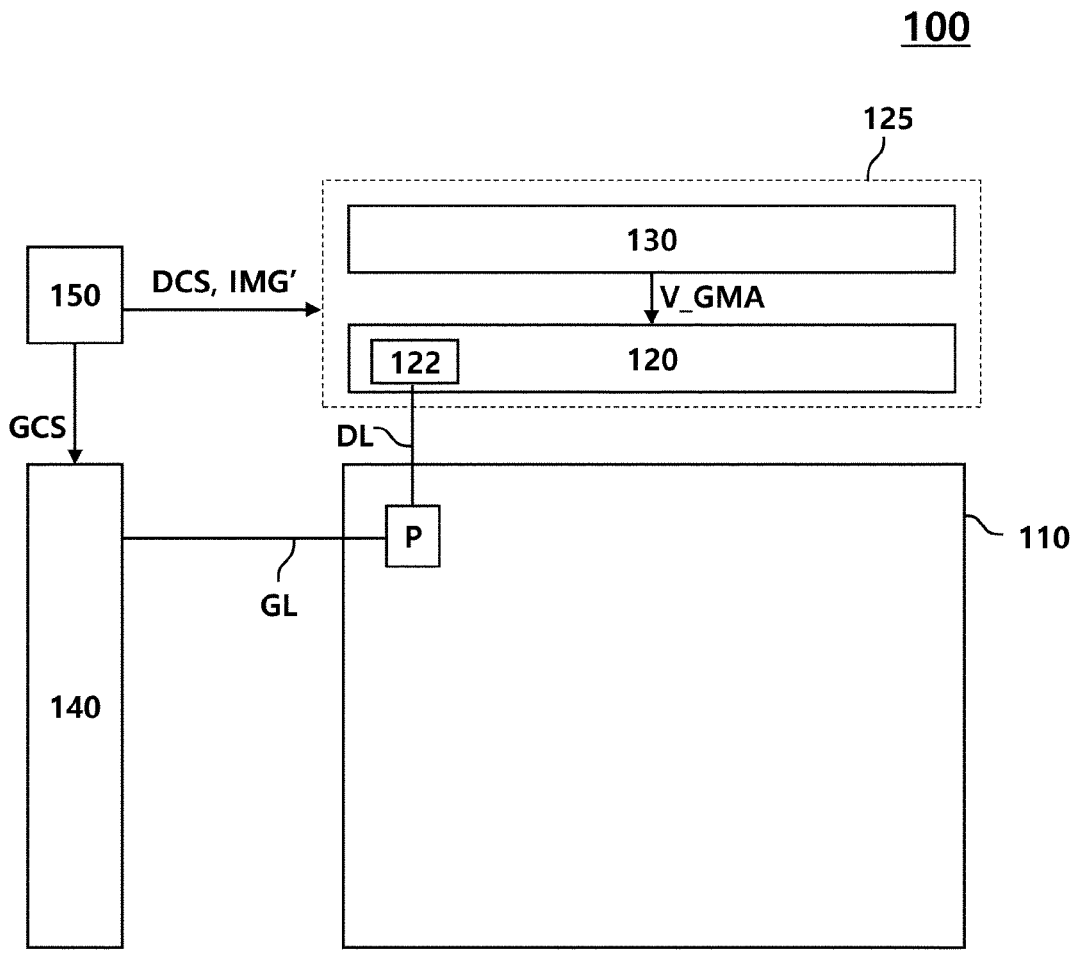
FIG. 1 is a configuration diagram of a display device in accordance with an embodiment.

FIG. 1 is a configuration diagram of a display device in accordance with an embodiment.

Referring to FIG. 1, a display device 100 may include a display panel 110 and a panel driving device 125, 140 and 150 which drives the display panel 110.

A plurality of data lines DL and a plurality of gate lines GL may be disposed in the display panel 110. Further, a plurality of pixels P may be disposed in the display panel 110. The plurality of pixels P may be disposed in the form of a matrix which is configured by a plurality of rows and a plurality of columns.

Devices 125, 140 and 150 which drive at least one component included in the display panel 110 may be referred to as the panel driving device. For example, a data driving device 125 including a data driving circuit 120 and a gamma voltage circuit 130, a gate driving device 140 and a data processing device 150 may be referred to as the panel driving device.

Each of the devices 125, 140 and 150 described above may be referred to as the panel driving device, and all or a plurality of devices among the devices 125, 140 and 150 may be referred to as the panel driving device.

In the panel driving device, the gate driving device 140 may supply a scan signal having a turn-on voltage or a turn-off voltage to a gate line GL. When the scan signal having the turn-on voltage is supplied to a pixel P, the corresponding pixel P is connected to a data line DL, and when the scan signal having the turn-off voltage is supplied to a pixel P, the connection between the corresponding pixel P and a data line DL is released.

The gate driving device 140 may include at least one gate driving circuit which is referred to as a gate driver IC (integrated circuit).

In the panel driving device, the data driving device 125 may include the data driving circuit 120 and the gamma voltage circuit 130.

The data driving circuit 120 generates a data voltage in a channel circuit 122 and supplies the data voltage to the data line DL. The data voltage supplied to the data line DL is supplied to the pixel P which is connected to the data line DL according to the scan signal. The pixel P may include a first color pixel, a second color pixel and a third color pixel.

The data voltage may include a first data voltage which is supplied to the first color pixel, a second data voltage which is supplied to the second color pixel, and a third data voltage which is supplied to the third color pixel.

In an embodiment, the first color pixel may be an R (red) pixel, the second color pixel may be a G (green) pixel, and the third color pixel may be a B (blue) pixel.

In general, the data driving circuit 120 may include a plurality of channel circuits 122. The data driving device 125 may include at least one data driving circuit 120.

The gamma voltage circuit 130 generates gamma reference voltages V_GMA and outputs the generated gamma reference voltages V_GMA to the data driving circuit 120.

In an embodiment, the gamma voltage circuit 130 may generate gamma reference voltages corresponding to different colors, respectively, during each horizontal driving period of the display device 100, and may output the generated gamma reference voltages to the data driving circuit 120. The gamma voltage circuit 130 may include a programmable gamma circuit which can change gamma reference voltages according to different colors.

In the panel driving device, the data processing device 150 may supply various control signals to the gate driving device 140 and the data driving device 125. The data processing device 150 may generate a gate control signal GCS which causes a scan to be started according to timing implemented in each frame, and may transmit the gate control signal GCS to the gate driving device 140. The data processing device 150 may convert image data, inputted from an external device, into image data RGB' to match a data signal format used in the data driving device 125, and may output the image data RGB' to the data driving device 125. The data processing device 150 may transmit a data control signal DCS which controls the data driving device 125 so that the data driving device 125 supplies a data voltage to each pixel P according to each timing.

The data control signal DCS may include a source start pulse (SSP), a source shift clock (SSC) and a source output enable (SOE) signal.

In an embodiment, when transmitting the image data RGB' corresponding to one row of the display panel 110 to the data driving device 125, the data processing device 150 may divisionally transmit the image data RGB' through a plurality of horizontal driving periods. The data processing device 150 may transmit, to the data driving device 125, different gamma set values during the respective horizontal driving periods.

In detail, the image data RGB' corresponding to one row may include first color data, second color data and third color data classified in the units of channels of the display panel 110. The data processing device 150 may transmit the first color data and a first gamma set value to the data driving device 125 during a first horizontal driving period 1H, and may transmit the second color data and a second gamma set value to the data driving device 125 during a second horizontal driving period 2H.

The data processing device 150 may transmit the third color data and a third gamma set value to the data driving device 125 during a third horizontal driving period 3H. The first gamma set value may be a set value for the gamma voltage circuit 130 to generate first gamma reference voltages corresponding to a first color, and the second gamma set value may be a set value for the gamma voltage circuit 130 to generate second gamma reference voltages corresponding to a second color. The third gamma set value may be a set value for the gamma voltage circuit 130 to generate third gamma reference voltages corresponding to a third color.

The data processing device 150 described above may be referred to as a timing controller.

Figure 2:
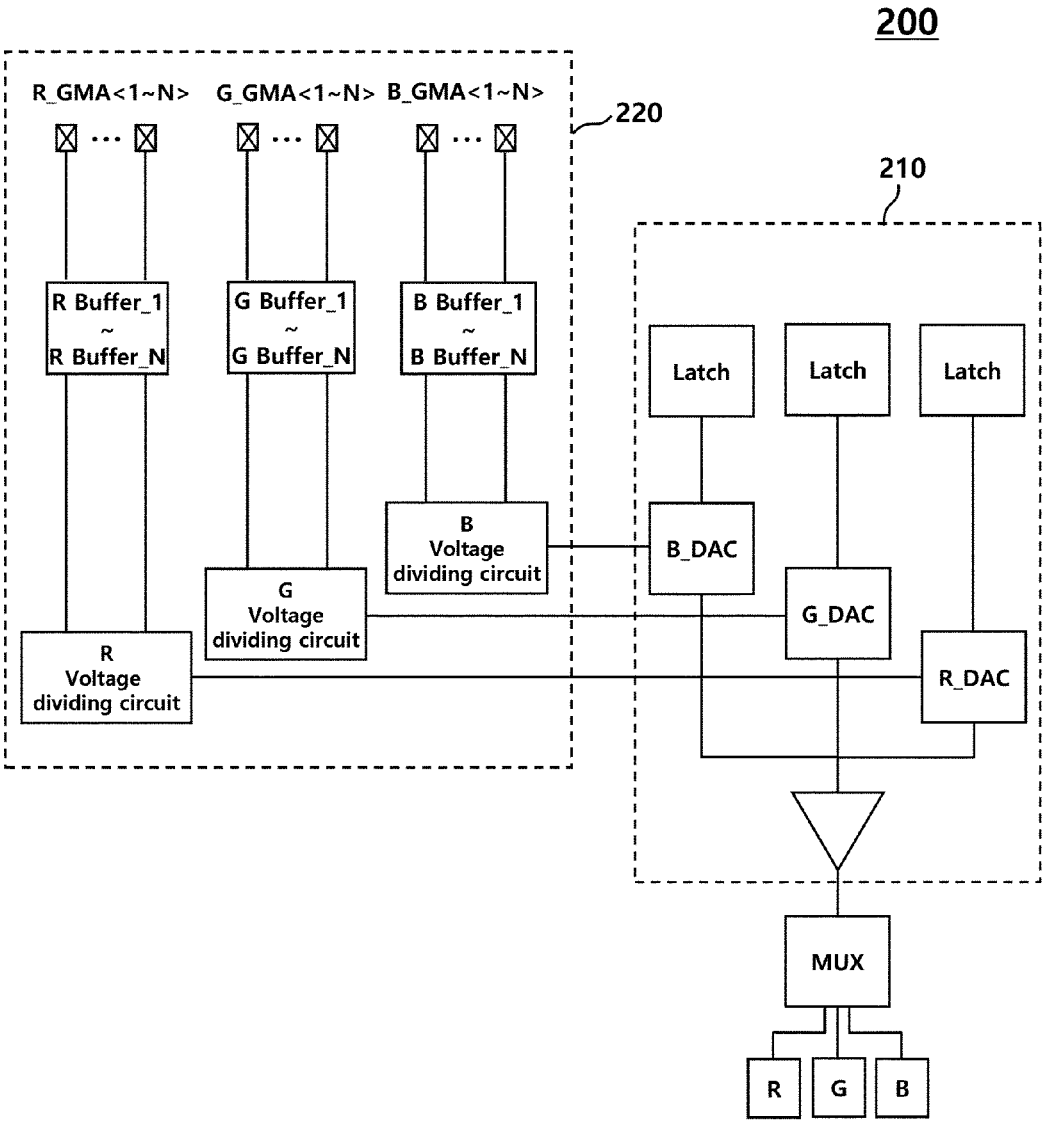
FIG. 2 is a configuration diagram of a general data driving device.

In a conventional data driving device 200, as illustrated in FIG. 2, a gamma voltage circuit 220 includes circuits for generating gamma reference voltages corresponding to a plurality of colors (for example, R, G and B of FIG. 2). Further, a channel circuit 210 includes digital-to-analog converters (DACs) for generating a data voltage corresponding to a first color, a data voltage corresponding to a second color and a data voltage corresponding to a third color. Therefore, the conventional data driving device 200 has problems in that the size thereof is large and the manufacturing cost thereof is high.

In an embodiment, in order to reduce the size of a data driving device, a programmable gamma circuit is applied to a gamma voltage circuit, and some components of a channel circuit are used in common. The data driving device generates data voltages in a manner different from the conventional art.

Detailed description for this is as follows.

Figure 3:
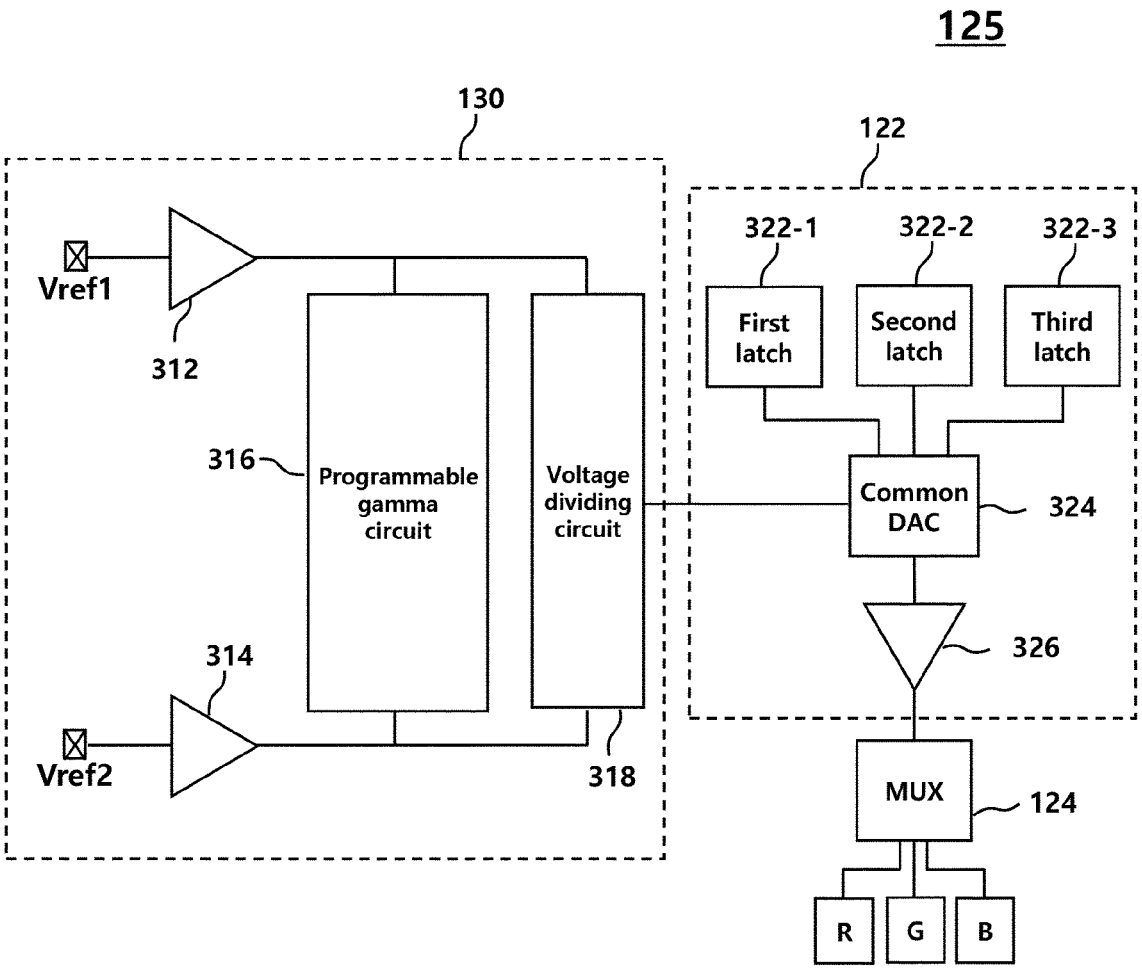
FIGS. 3 to 5 are diagrams to assist in the explanation of a configuration of a data driving device in accordance with an embodiment.
Figure 4:
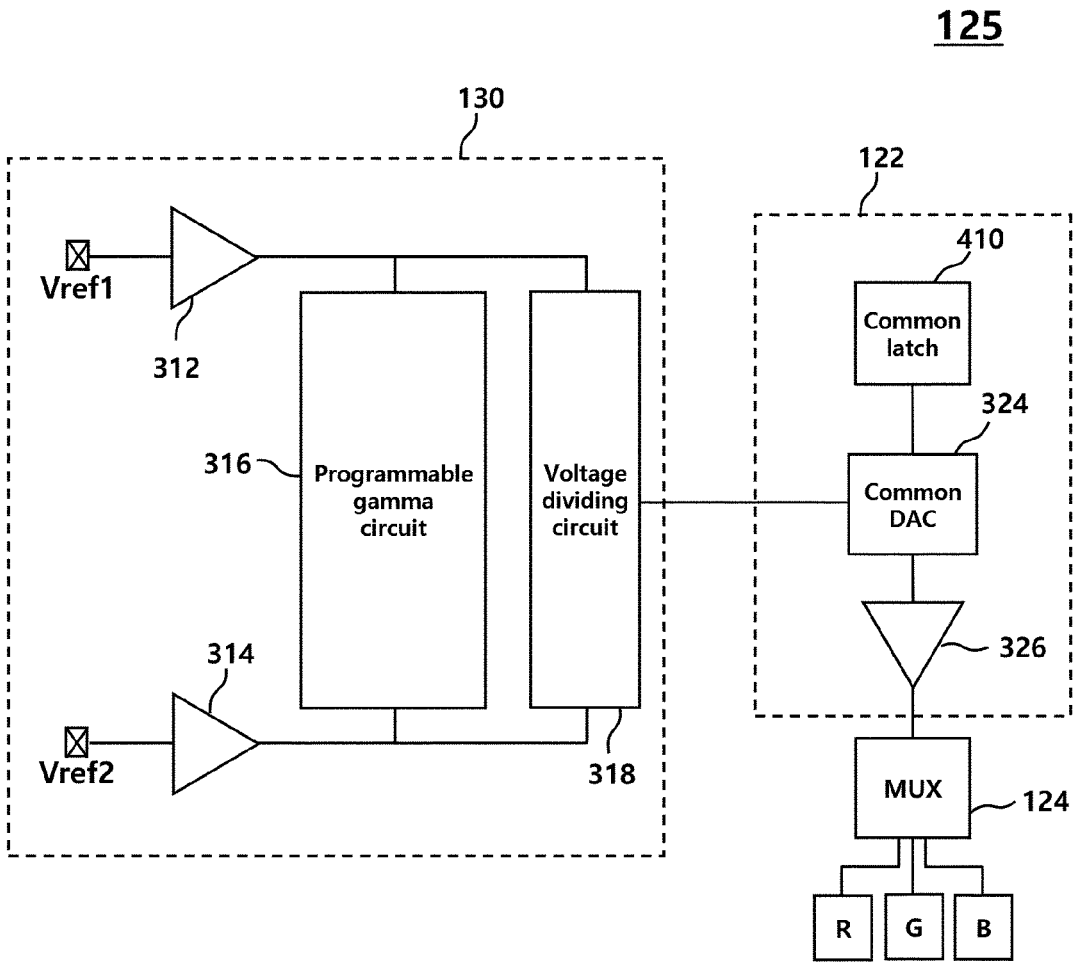
Figure 5:
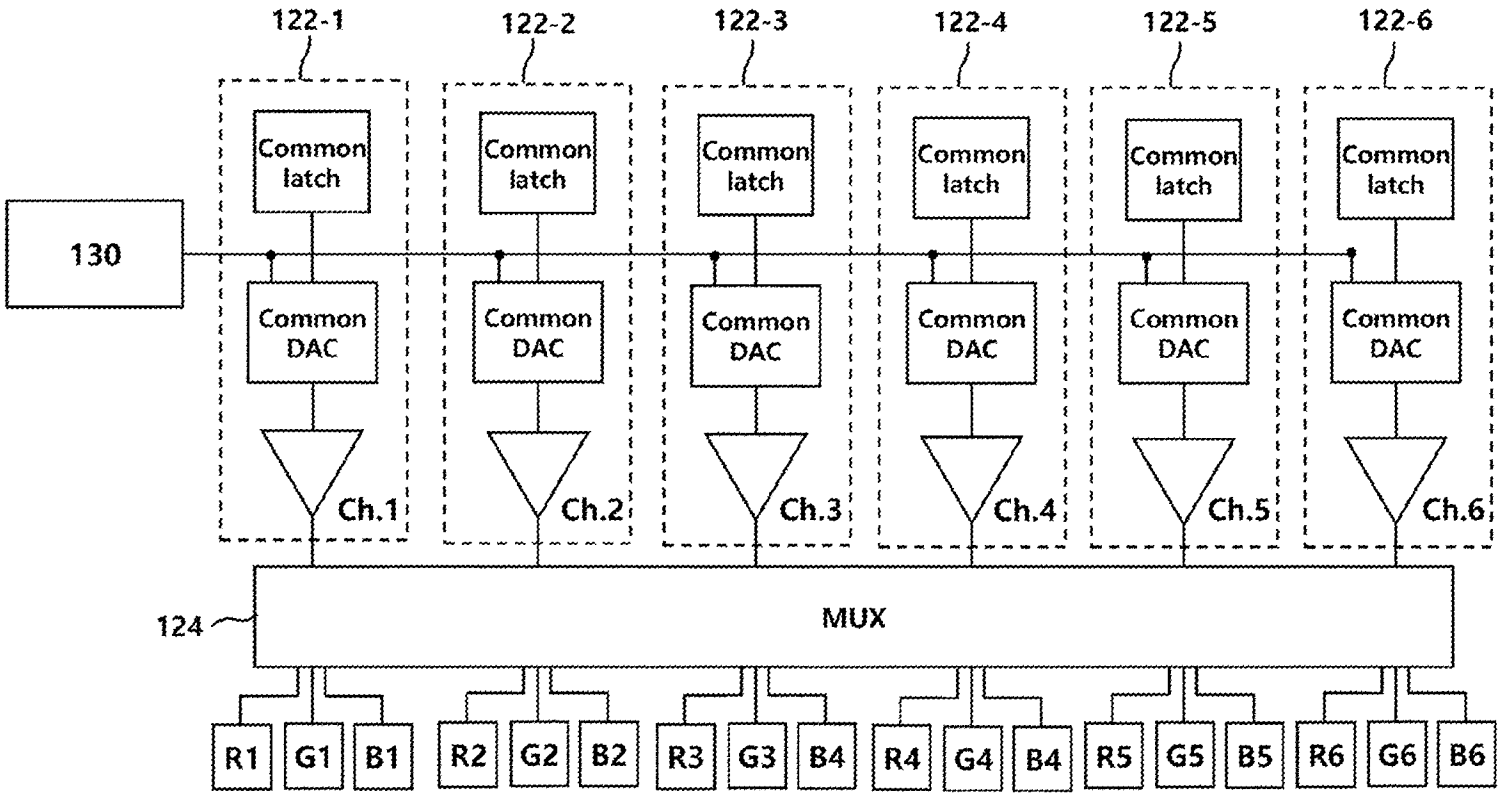

FIGS. 3 to 5 are diagrams to assist in the explanation of a configuration of a data driving device in accordance with an embodiment.

Referring to FIG. 3, a data driving device 125 in accordance with an embodiment may include a gamma voltage circuit 130 and a channel circuit 122. The channel circuit 122 is included in the data driving circuit 120 as illustrated in FIG. 1.

The gamma voltage circuit 130 may output first gamma reference voltages corresponding to a first color during a first horizontal driving period, and may output second gamma reference voltages corresponding to a second color during a second horizontal driving period.

The gamma voltage circuit 130 may output third gamma reference voltages corresponding to a third color during a third horizontal driving period.

During the first horizontal driving period, the gamma voltage circuit 130 may output the first gamma reference voltages according to a first gamma set value transmitted by the data processing device 150.

During the second horizontal driving period, the gamma voltage circuit 130 may output the second gamma reference voltages according to a second gamma set value transmitted by the data processing device 150.

During the third horizontal driving period, the gamma voltage circuit 130 may output the third gamma reference voltages according to a third gamma set value transmitted by the data processing device 150.

The gamma voltage circuit 130 may include a first gamma buffer 312, a second gamma buffer 314, a programmable gamma circuit 316 and a voltage dividing circuit 318.

The first gamma buffer 312 may receive a first reference voltage Vref1 and output a highest buffering voltage.

The second gamma buffer 314 may receive a second reference voltage Vref2 and output a lowest buffering voltage. The first reference voltage Vref1 and the second reference voltage Vref2 may be outputted from a power management device (not illustrated) of the display device 100.

The programmable gamma circuit 316 may output first buffering voltages corresponding to the first color during the first horizontal driving period.

The programmable gamma circuit 316 may output second buffering voltages corresponding to the second color during the second horizontal driving period.

The programmable gamma circuit 316 may output third buffering voltages corresponding to the third color during the third horizontal driving period.

The programmable gamma circuit 316 may include a resistance string (not illustrated) which divides the highest buffering voltage and the lowest buffering voltage into a plurality of divided voltages, a decoding circuit (not illustrated) which decodes the plurality of divided voltages and outputs a plurality of decoding voltages, and a plurality of buffers (not illustrated) which buffer the plurality of decoding voltages.

During the first horizontal driving period, the decoding circuit (not illustrated) may output a plurality of decoding voltages corresponding to the first color according to the first gamma set value. Through this, the plurality of buffers (not illustrated) may output the first buffering voltages.

During the second horizontal driving period, the decoding circuit (not illustrated) may output a plurality of decoding voltages corresponding to the second color according to the second gamma set value. Through this, the plurality of buffers (not illustrated) may output the second buffering voltages.

During the third horizontal driving period, the decoding circuit (not illustrated) may output a plurality of decoding voltages corresponding to the third color according to the third gamma set value. Through this, the plurality of buffers (not illustrated) may output the third buffering voltages.

The voltage dividing circuit 318 may include a resistance string, that is, a plurality of resistances which are connected in series.

During the first horizontal driving period, the voltage dividing circuit 318 may output the first gamma reference voltages by dividing the highest buffering voltage, the lowest buffering voltage and the first buffering voltages.

During the second horizontal driving period, the voltage dividing circuit 318 may output the second gamma reference voltages by dividing the highest buffering voltage, the lowest buffering voltage and the second buffering voltages.

During the third horizontal driving period, the voltage dividing circuit 318 may output the third gamma reference voltages by dividing the highest buffering voltage, the lowest buffering voltage and the third buffering voltages.

As described above, since the gamma voltage circuit 130 in accordance with the embodiment includes the programmable gamma circuit 316, the number of buffers, the number of resistance strings and the number of wirings may be reduced as compared to the conventional gamma voltage circuit 220.

The gamma voltage circuit 130 in accordance with the embodiment may change gamma reference voltages during each horizontal driving period, and may output the changed gamma reference voltages.

In other words, the gamma voltage circuit 130 may output the first gamma reference voltages corresponding to the first color during the first horizontal driving period, and may output the second gamma reference voltages corresponding to the second color during the second horizontal driving period.

The gamma voltage circuit 130 may output the third gamma reference voltages corresponding to the third color during the third horizontal driving period.

In FIG. 3, the channel circuit 122 may output a first data voltage using first color data corresponding to the first color and the first gamma reference voltages during the first horizontal driving period, and may output a second data voltage using second color data corresponding to the second color and the second gamma reference voltages during the second horizontal driving period.

The channel circuit 122 may include a first latch 322-1, a second latch 322-2, a common DAC 324, and an output buffer 326. The channel circuit 122 may further include a third latch 322-3.

The first latch 322-1 may temporarily store the first color data, and may output the first color data to the common DAC 324 during the first horizontal driving period. The first color data may be color data of one channel among first color data received by the data driving device 125 from the data processing device 150.

The second latch 322-2 may temporarily store the second color data, and may output the second color data to the common DAC 324 during the second horizontal driving period. The second color data may be color data of one channel among second color data received by the data driving device 125 from the data processing device 150.

The third latch 322-3 may temporarily store third color data, and may output the third color data to the common DAC 324 during the third horizontal driving period. The third color data may be color data of one channel among third color data received by the data driving device 125 from the data processing device 150.

During the first horizontal driving period, the common DAC 324 may receive the first color data from the first latch 322-1, may receive the first gamma reference voltages from the gamma voltage circuit 130, and may output the first data voltage.

During the second horizontal driving period, the common DAC 324 may receive the second color data from the second latch 322-2, may receive the second gamma reference voltages from the gamma voltage circuit 130, and may output the second data voltage.

When the channel circuit 122 further includes the third latch 322-3, during the third horizontal driving period, the common DAC 324 may receive the third color data from the third latch 322-3, may receive the third gamma reference voltages from the gamma voltage circuit 130, and may output the third data voltage.

During the first horizontal driving period, the common DAC 324 may output the first data voltage by selecting one gamma reference voltage among the first gamma reference voltages according to the first color data.

During the second horizontal driving period, the common DAC 324 may output the second data voltage by selecting one gamma reference voltage among the second gamma reference voltages according to the second color data.

During the third horizontal driving period, the common DAC 324 may output the third data voltage by selecting one gamma reference voltage among the third gamma reference voltages according to the third color data.

As described above, in the channel circuit 122 in accordance with the embodiment, since the one common DAC 324 outputs different data voltages during respective horizontal driving periods, the number of DACs and the number of wirings may be reduced as compared to the conventional channel circuit 210.

In an embodiment, the channel circuit 122 may share a latch.

In detail, in the channel circuit 122, the first latch 322-1, the second latch 322-2 and the third latch 322-3 may be replaced with one common latch 410 as illustrated in FIG. 4.

The common latch 410 may temporarily store the first color data and output the first color data to the common DAC 324 during the first horizontal driving period, and may temporarily store the second color data and output the second color data to the common DAC 324 during the second horizontal driving period.

The common latch 410 may temporarily store the third color data and output the third color data to the common DAC 324 during the third horizontal driving period.

In FIG. 4, during the first horizontal driving period, the common DAC 324 may receive the first color data from the common latch 410, may receive the first gamma reference voltages from the gamma voltage circuit 130, and may output the first data voltage.

During the second horizontal driving period, the common DAC 324 may receive the second color data from the common latch 410, may receive the second gamma reference voltages from the gamma voltage circuit 130, and may output the second data voltage.

During the third horizontal driving period, the common DAC 324 may receive the third color data from the common latch 410, may receive the third gamma reference voltages from the gamma voltage circuit 130, and may output the third data voltage.

In FIGS. 3 and 4, the output buffer 326 may buffer the first data voltage and output the buffered first data voltage to a multiplexer 124 during the first horizontal driving period, and may buffer the second data voltage and output the buffered second data voltage to the multiplexer 124 during the second horizontal driving period.

The output buffer 326 may buffer the third data voltage and output the buffered third data voltage to the multiplexer 124 during the third horizontal driving period.

The multiplexer 124 included in the data driving circuit 120 of the data driving device 125 may selectively connect a first color pixel (for example, R of FIGS. 3 and 4), a second color pixel (for example, G of FIGS. 3 and 4) and a third color pixel (for example, B of FIGS. 3 and 4) disposed in the display panel 110, to the channel circuit 122.

In an embodiment, during the first horizontal driving period, the multiplexer 124 may connect the first color pixel and the channel circuit 122 and thereby input the first data voltage to the first color pixel.

During the second horizontal driving period, the multiplexer 124 may connect the second color pixel and the channel circuit 122 and thereby input the second data voltage to the second color pixel.

During the third horizontal driving period, the multiplexer 124 may connect the third color pixel and the channel circuit 122 and thereby input the third data voltage to the third color pixel.

In the above, an operating configuration of one channel circuit 122 has been mainly described. Hereinafter, an operating configuration of a plurality of channel circuits included in the data driving device 125, that is, a plurality of channel circuits included in the data driving circuit 120 of the data driving device 125, will be described.

Referring to FIG. 5, the data driving circuit 120 may include a plurality of channel circuits 122-1 to 122-6. In other words, the data driving device 125 may include the gamma voltage circuit 130 and the plurality of channel circuits 122-1 to 122-6. In FIG. 5, the number of the plurality of channel circuits 122-1 to 122-6 is limited to six for the sake of convenience in explanation. However, when an embodiment is actually applied, the number of the plurality of channel circuits 122-1 to 122-6 may be increased.

FIG. 5 illustrates that each channel circuit includes the common latch 410. However, when an embodiment is actually applied, not the common latch 410 but the first latch 322-1, the second latch 322-2 and the third latch 322-3 may be included in each channel circuit.

Figure 6:
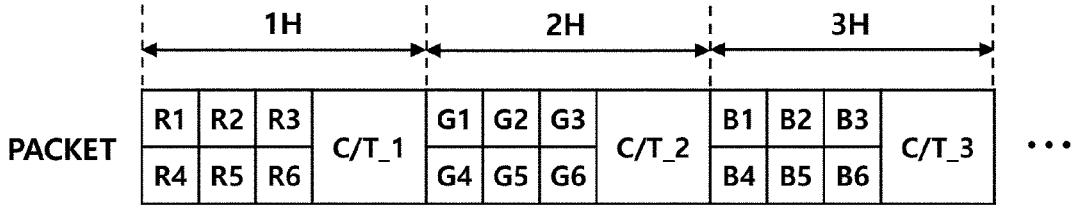
FIG. 6 is a diagram to assist in the explanation of a configuration in which the data driving device in accordance with the embodiment receives color data.

In an embodiment, during a first horizontal driving period 1H, the data driving device 125 may receive first color data R1, R2, R3, R4, R5 and R6 and a first gamma set value C/T_1 from the data processing device 150, as illustrated in FIG. 6. The data driving device 125 may receive the first color data R1, R2, R3, R4, R5 and R6 and the first gamma set value C/T_1 in the form of a packet. The first color data R1, R2, R3, R4, R5 and R6 may include first color data of a plurality of channels Ch.1 to Ch.6, respectively.

The first color data received by the data driving device 125 may be distributed to the common latches of the respective channels Ch.1 to Ch.6, and the plurality of channel circuits 122-1 to 122-6 may output first data voltages of the respective channels Ch.1 to Ch.6.

The multiplexer 124 may connect the plurality of channel circuits 122-1 to 122-6 and first color pixels of the respective channels Ch.1 to Ch.6, and may input data voltages of the respective channels Ch.1 to Ch.6 to the first color pixels of the respective channels Ch.1 to Ch.6.

During a second horizontal driving period 2H, the data driving device 125 may receive second color data G1, G2, G3, G4, G5 and G6 and a second gamma set value C/T_2 from the data processing device 150, as illustrated in FIG. 6. The data driving device 125 may receive the second color data G1, G2, G3, G4, G5 and G6 and the second gamma set value C/T_2 in the form of a packet. The second color data G1, G2, G3, G4, G5 and G6 may include second color data of the plurality of channels Ch.1 to Ch.6, respectively.

The second color data received by the data driving device 125 may be distributed to the common latches of the respective channels Ch.1 to Ch.6, and the plurality of channel circuits 122-1 to 122-6 may output second data voltages of the respective channels Ch.1 to Ch.6.

The multiplexer 124 may connect the plurality of channel circuits 122-1 to 122-6 and second color pixels of the respective channels Ch.1 to Ch.6, and may input data voltages of the respective channels Ch.1 to Ch.6 to the second color pixels of the respective channels Ch.1 to Ch.6.

During a third horizontal driving period 3H, the data driving device 125 may receive third color data B1, B2, B3, B4, B5 and B6 and a third gamma set value C/T_3 from the data processing device 150, as illustrated in FIG. 6. The data driving device 125 may receive the third color data B1, B2, B3, B4, B5 and B6 and the third gamma set value C/T_3 in the form of a packet. The third color data B1, B2, B3, B4, B5 and B6 may include third color data of the plurality of channels Ch.1 to Ch.6, respectively.

The third color data received by the data driving device 125 may be distributed to the common latches of the respective channels Ch.1 to Ch.6, and the plurality of channel circuits 122-1 to 122-6 may output third data voltages of the respective channels Ch.1 to Ch.6.

The multiplexer 124 may connect the plurality of channel circuits 122-1 to 122-6 and third color pixels of the respective channels Ch.1 to Ch.6, and may input data voltages of the respective channels Ch.1 to Ch.6 to the third color pixels of the respective channels Ch.1 to Ch.6.

Figure 7:
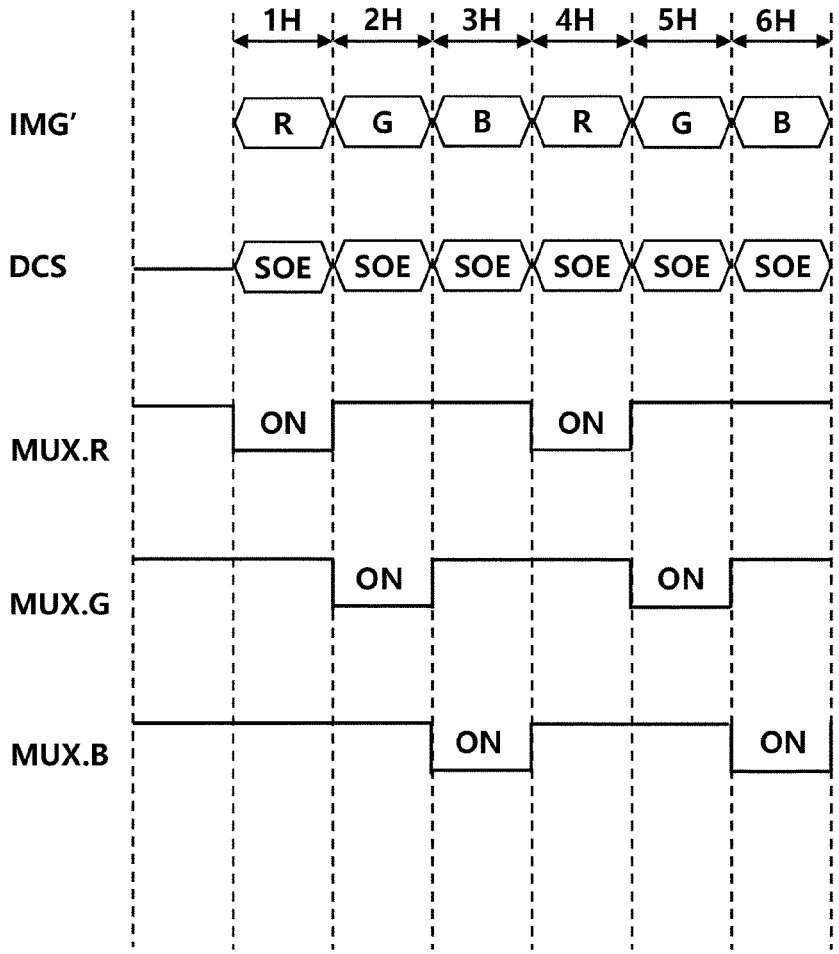
FIG. 7 is a diagram to assist in the explanation of a configuration in which the data driving device in accordance with the embodiment generates data voltages for each color and supplies the generated data voltages to pixels of a display panel.

In an embodiment, during the first horizontal driving period 1H, the data driving device 125 may control the switching of the multiplexer 124, as illustrated in FIG. 7, according to a source output enable signal SOE received from the data processing device 150, and thereby, may supply the first data voltages to the first color pixels.

During the second horizontal driving period 2H, the data driving device 125 may control the switching of the multiplexer 124, as illustrated in FIG. 7, according to the source output enable signal SOE, and thereby, may supply the second data voltages to the second color pixels.

During the third horizontal driving period 3H, the data driving device 125 may control the switching of the multiplexer 124, as illustrated in FIG. 7, according to the source output enable signal SOE, and thereby, may supply the third data voltages to the third color pixels.

During a period in which power is supplied to the display device 100, the data driving device 125 may repeatedly operate the above configuration, and thereby, may normally display image data on the display panel 110.

Hereinafter, a process in which the data driving device 125 including the gamma voltage circuit 130 and the channel circuit 122 drives the display panel 110 will be described.

Figure 8:
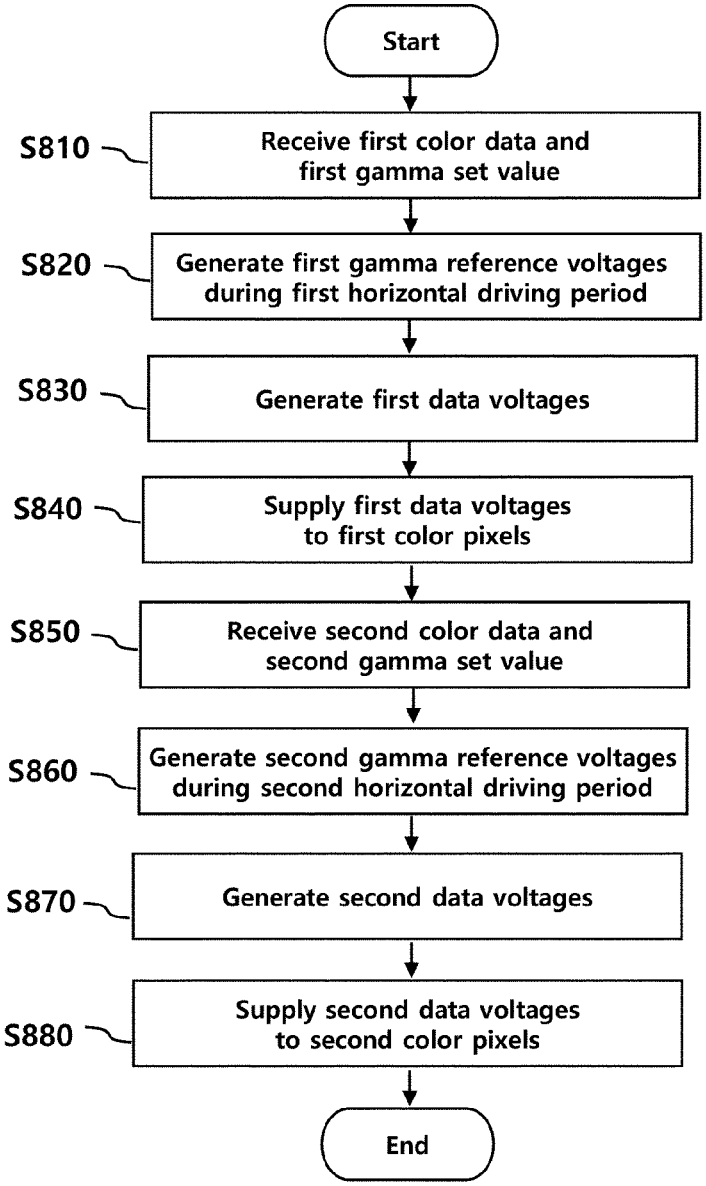
FIG. 8 is a flowchart illustrating a process in which the data driving device in accordance with the embodiment drives the display panel.

FIG. 8 is a flowchart illustrating a process in which the data driving device in accordance with the embodiment drives the display panel.

The data driving device 125 may receive, from the data processing device 150, first color data classified in the units of channels of the display panel 110 and a first gamma set value (S810). The fact that first color data are classified in the units of channels may mean that the first color data include first color data of a plurality of respective channels as illustrated in FIG. 6.

During a first horizontal driving period, the data driving device 125 may generate first gamma reference voltages corresponding to a first color by using the first gamma set value (S820).

The data driving device 125 may generate first data voltages by using the first color data and the first gamma reference voltages, and may supply the first data voltages to first color pixels disposed on one row of the display panel 110 (S830 and S840).

After the step S840, the data driving device 125 may receive, from the data processing device 150, second color data classified in the units of channels of the display panel 110 and a second gamma set value (S850).

During a second horizontal driving period, the data driving device 125 may generate second gamma reference voltages corresponding to a second color by using the second gamma set value (S860).

The data driving device 125 may generate second data voltages by using the second color data and the second gamma reference voltages, and may supply the second data voltages to second color pixels disposed on the one row (S870 and S880).

At the step S810, the data driving device 125 may receive the first color data and the first gamma set value before or during the first horizontal driving period.

In the same manner, at the step S850, the data driving device 125 may receive the second color data and the second gamma set value before or during the second horizontal driving period.

After the step S880, the data driving device 125 may receive, from the data processing device 150, third color data classified in the units of channels of the display panel 110 and a third gamma set value.

During a third horizontal driving period, the data driving device 125 may generate third gamma reference voltages corresponding to a third color by using the third gamma set value, and may generate third data voltages by using the third color data and the third gamma reference voltages.

Thereafter, the data driving device 125 may supply the third data voltages to third color pixels disposed on the one row.

What is claimed is:

1. A data driving device comprising:

a gamma voltage circuit configured to output first gamma reference voltages corresponding to a first color during a first horizontal driving period, to output second gamma reference voltages corresponding to a second color during a second horizontal driving period that follows the first horizontal driving period, and to output third gamma reference voltages corresponding to a third color during a third horizontal driving period that follows the second horizontal driving period; and a channel circuit configured to output a first data voltage by using first color data corresponding to the first color and the first gamma reference voltages during the first horizontal driving period, to output a second data voltage by using second color data corresponding to the second color and the second gamma reference voltages during the second horizontal driving period, and to output a third data voltage by using third color data corresponding to the third color and the third gamma reference voltages during the third horizontal driving period.

2. The data driving device according to claim 1, wherein the channel circuit comprises:

a first latch configured to temporarily store the first color data and to output the first color data during the first horizontal driving period;

a second latch configured to temporarily store the second color data and to output the second color data during the second horizontal driving period;

a third latch configured to temporarily store the third color data and to output the third color data during the third horizontal driving period; and a common digital-to-analog converter (DAC) configured to output the first data voltage after having received the first color data from the first latch and having received the first gamma reference voltages from the gamma voltage circuit during the first horizontal driving period, to output the second data voltage after having received the second color data from the second latch and having received the second gamma reference voltages from the gamma voltage circuit during the second horizontal driving period, and to output the third data voltage after having received the third color data from the third latch and having received the third gamma reference voltages from the gamma voltage circuit during the third horizontal driving period.

3. The data driving device according to claim 1, wherein the gamma voltage circuit comprises:

a first gamma buffer configured to receive a first reference voltage and to output a highest buffering voltage;

a second gamma buffer configured to receive a second reference voltage and to output a lowest buffering voltage by;

a programmable gamma circuit configured to output first buffering voltages corresponding to the first color during the first horizontal driving period, to output second buffering voltages corresponding to the second color during the second horizontal driving period, and to output third buffering voltages corresponding to the third color during the third horizontal driving period; and a voltage dividing circuit, comprising a plurality of resistances connected in series, configured to output the first gamma reference voltages by dividing the highest buffering voltage, the lowest buffering voltage, and the first buffering voltages during the first horizontal driving period, to output the second gamma reference voltages by dividing the highest buffering voltage, the lowest buffering voltage, and the second buffering voltages during the second horizontal driving period, and to output the third gamma reference voltages by dividing the highest buffering voltage, the lowest buffering voltage and the third buffering voltages during the third horizontal driving period.

4. The data driving device according to claim 1, further comprising:

a multiplexer configured to selectively connect a first color pixel and a second color pixel, disposed in a display panel, with the channel circuit, wherein the first color pixel is connected with the channel circuit to input the first data voltage to the first color pixel during the first horizontal driving period and the second color pixel is connected with the channel circuit to input the second data voltage to the second color pixel during the second horizontal driving period.

5. The data driving device according to claim 1, wherein the channel circuit comprises:

a common latch configured to temporarily store and output the first color data during the first horizontal driving period, to temporarily store and output the second color data during the second horizontal driving period, and to temporarily store and output the third color data during the third horizontal driving period; and a common digital-to-analog converter (DAC) configured to output the first data voltage after having received the first color data from the common latch and the first gamma reference voltages from the gamma voltage circuit during the first horizontal driving period, to output the second data voltage after having received the second color data from the common latch and the second gamma reference voltages from the gamma voltage circuit during the second horizontal driving period, and to output the third data voltage after having received the third color data from the common latch and the third gamma reference voltages from the gamma voltage circuit during the third horizontal driving period.

6. A method for driving a display panel by a data driving device, comprising:

receiving first color data corresponding to all channels of the display panel and a first gamma set value from a data processing device;

generating first gamma reference voltages corresponding to a first color by using the first gamma set value during a first horizontal driving period;

generating first data voltages by using the first color data and the first gamma reference voltages;

supplying the first data voltages to first color pixels disposed on one row of the display panel during the first horizontal driving period;

receiving second color data corresponding to all the channels of the display panel and a second gamma set value from the data processing device;

generating second gamma reference voltages corresponding to a second color by using the second gamma set value during a second horizontal driving period that follows the first horizontal driving period;

generating second data voltages by using the second color data and the second gamma reference voltages;

supplying the second data voltages to second color pixels disposed on the one row during the second horizontal driving period;

receiving third color data corresponding to all the channels of the display panel and a third gamma set value from the data processing device;

generating third gamma reference voltages corresponding to a third color by using the third gamma set value during a third horizontal driving period that follows the second horizontal driving period;

generating third data voltages by using the third color data and the third gamma reference voltages; and supplying the third data voltages to third color pixels disposed on the one row during the third horizontal driving period.

7. The method according to claim 6, wherein the data driving device comprises a gamma voltage circuit and a plurality of channel circuits, each channel circuit comprising:

a common latch configured to temporarily store and output the first color data during the first horizontal driving period, to temporarily store and output the second color data during the second horizontal driving period, and to temporarily store and output the third color data during the third horizontal driving period; and a common DAC configured to output the first data voltage after having received the first color data from the common latch and the first gamma reference voltages from the gamma voltage circuit during the first horizontal driving period, to output the second data voltage after having received the second color data from the common latch and the second gamma reference voltages from the gamma voltage circuit during the second horizontal driving period, and to output the third data voltage after having received the third color data from the common latch and the third gamma reference voltages from the gamma voltage circuit during the third horizontal driving period.

8. The method according to claim 6, wherein the data driving device comprises a gamma voltage circuit, the gamma voltage circuit comprising:

a first gamma buffer configured to receive a first reference voltage and to output a highest buffering voltage;

a second gamma buffer configured to receive a second reference voltage and to output a lowest buffering voltage by;

a programmable gamma circuit configured to output first buffering voltages corresponding to the first color during the first horizontal driving period, to output second buffering voltages corresponding to the second color during the second horizontal driving period, and to output third buffering voltages corresponding to the third color during the third horizontal driving period; and a voltage dividing circuit, comprising a plurality of resistances connected in series, configured to output the first gamma reference voltages by dividing the highest buffering voltage, the lowest buffering voltage and the first buffering voltages during the first horizontal driving period, to output the second gamma reference voltages by dividing the highest buffering voltage, the lowest buffering voltage and the second buffering voltages during the second horizontal driving period, and to output the third gamma reference voltages by dividing the highest buffering voltage, the lowest buffering voltage and the third buffering voltages during the third horizontal driving period.

9. The method according to claim 6, wherein in supplying the first data voltages to the first color pixels, the data driving device supplies the first data voltages to the first color pixels according to a source output enable signal received from the data processing device.

* * * * *